US008852015B1

(12) United States Patent
Hoang

(10) Patent No.: US 8,852,015 B1
(45) Date of Patent: Oct. 7, 2014

(54) GOLF TRAINING AID

(71) Applicant: Ben Hoang, Calgary (CA)

(72) Inventor: Ben Hoang, Calgary (CA)

( * ) Notice: Subject to any disclaimer, the term of this patent is extended or adjusted under 35 U.S.C. 154(b) by 0 days.

(21) Appl. No.: 14/064,060

(22) Filed: Oct. 25, 2013

(51) Int. Cl.
*A63B 69/36* (2006.01)
*A63B 69/00* (2006.01)

(52) U.S. Cl.
CPC ..... *A63B 69/0059* (2013.01); *A63B 69/3608* (2013.01)
USPC ..... 473/214; 473/212

(58) Field of Classification Search
CPC ..... A63B 69/0059
USPC ..... 473/207, 212, 213, 214, 215
See application file for complete search history.

(56) References Cited

U.S. PATENT DOCUMENTS 3,740,052 A * 6/1973 Arkin ..... 473/214
3,937,465 A * 2/1976 Roland ..... 473/461
5,154,416 A * 10/1992 Smull et al. ..... 473/458
5,203,570 A * 4/1993 Graham ..... 473/214
5,451,060 A * 9/1995 Dalbo ..... 473/215
5,795,238 A * 8/1998 Nicholson ..... 473/214
6,767,290 B1 * 7/2004 Tan ..... 473/212

* cited by examiner

*Primary Examiner* — Nini Legesse
(74) *Attorney, Agent, or Firm* — Fish & Richardson P.C.

(57) ABSTRACT

A golf training aid constructed of flexible material that stretches when deployed and maintains tensions along the wearer's upper and lower arm including a shoulder harness including a first shoulder portion and a second shoulder portion, the first shoulder portion including a strap that is fixedly attached to a back portion of the first shoulder portion and can be detachably fixed after passing around a body of a wearer to a front portion of the second shoulder portion to maintain the shoulder harness on the wearer while the wearer executes a golf swing and an arm extension attached to the second shoulder portion, the arm extension including an upper attachment portion, lower attachment portion and wrist portion, the upper and lower attachment portions can secure the arm extension in place at upper and lower portions of a wearer's arm to maintain the arm extension over the elbow of the wearer.

9 Claims, 3 Drawing Sheets

GOLF TRAINING AID

TECHNICAL FIELD

The subject matter of this disclosure relates to golf training aids.

BACKGROUND

Golf is a popular sport that can be played by people of all ages and skill levels. While golf can be enjoyed by anyone, golf is nevertheless a game of skill that requires practice and repetition to achieve any appreciable level of competence. In particular, a person may require many hours at a driving range or with a swing instructor in order to improve the mechanics of their golf swing.

SUMMARY

The subject matter of this disclosure relates to golf training aids. In general, in one aspect, a golf training aid is disclosed that includes a shoulder harness including a first shoulder portion and a second shoulder portion, the first shoulder portion includes a strap that is fixedly attached to a back portion of the first shoulder portion and is configured to be detachably fixed after passing around a body of a wearer wearing the golf training aid to a front portion of the second shoulder portion so as to maintain the shoulder harness on the wearer while the wearer executes a golf swing, and an arm extension attached to the second shoulder portion. The arm extension is configured to be deployed down the wearer's arm, the arm extension including an upper attachment portion, lower attachment portion and wrist portion. The upper and lower attachment portions are configured for securing the arm extension in place at upper and lower portions of a wearer's arm so as to maintain the arm extension over the elbow of the wearer. The wrist portion includes a grip portion for enabling the wearer to maintain a grip on a distal portion of the arm extension when deployed. The arm extension is constructed of flexible material that stretches when deployed and maintains tension along the upper and lower arm of the wearer so as to restrict bending of the elbow as the wearer executes the golf swing.

Embodiments of the subject matter can include one or more of the following features. The grip portion can include a strap configured for wrapping around the wearer's hand so as to increase tension along the arm extension. The arm extension can be configured to be attached to either the first or second shoulder portion so as to enable training for either left or right handed golfers. The arm extension can be constructed of a woven and knitted elastic material. The arm extension can be constructed of a stretchable material so as to create tension along the length and localized pressure at the elbow portion of the arm extension after deployment so as to inhibit bending of the elbow of the wearer during golf swing execution.

Embodiments of the disclosed subject matter can realize none, one or more of the following advantages. The golf swing aid can be easily adjusted to fit any size user and configured to apply a desirable amount of tension so as to inhibit bending of the elbow. The golf swing aid can be deployed for either right or left handed golfers. The golf swing aid can be easily deployed or disassembled for compact storage.

The details of one or more embodiments of the subject matter are set forth in the accompanying drawings and the description below. Other features, objects, and advantages of the subject matter will be apparent from the description and drawings, and from the claims.

DESCRIPTION OF DRAWINGS

Like reference symbols in the various drawings indicate like elements.

DETAILED DESCRIPTION

In general, the subject matter disclosed herein describes a golf training aid constructed of flexible material that resists motion in one or more directions so that a wearer of the golf training aid can feel resistance when the wearer executes an improper golf swing. That is, if a wearer of the golf training aid attempts to execute a golf swing using less than ideal swing mechanics, the wearer will feel resistance at one or more locations along the wear's arm according to the manner in which the golf swing mechanics are incorrect. For example, if the wearer's elbow begins to "break" (i.e., bend), the wearer may feel some level of resistance that corresponds to the amount of elbow break at or near the wearer's elbow joint (e.g., the greater the break, the greater the resistance). As another example, if the wearer's wrist begins to break, the wearer may feel some level of resistance that corresponds to the amount of wrist break at or near the wearer's wrist joint. Other joints (e.g., shoulder) along a wear's arm may also feel resistance based on the particulars of the wearer's swing mechanics. Over time, use of the golf training aid can improve the wearer's golf swing by creating muscle memory of a proper golf swing through numerous golf swing repetitions while wearing the golf training aid and adjusting one's swing to feel a minimal amount of resistance. In some embodiments, the golf training aid can be constructed using Neoprene, nylon, other flexible materials, and/or combinations of these.

Figure 1:
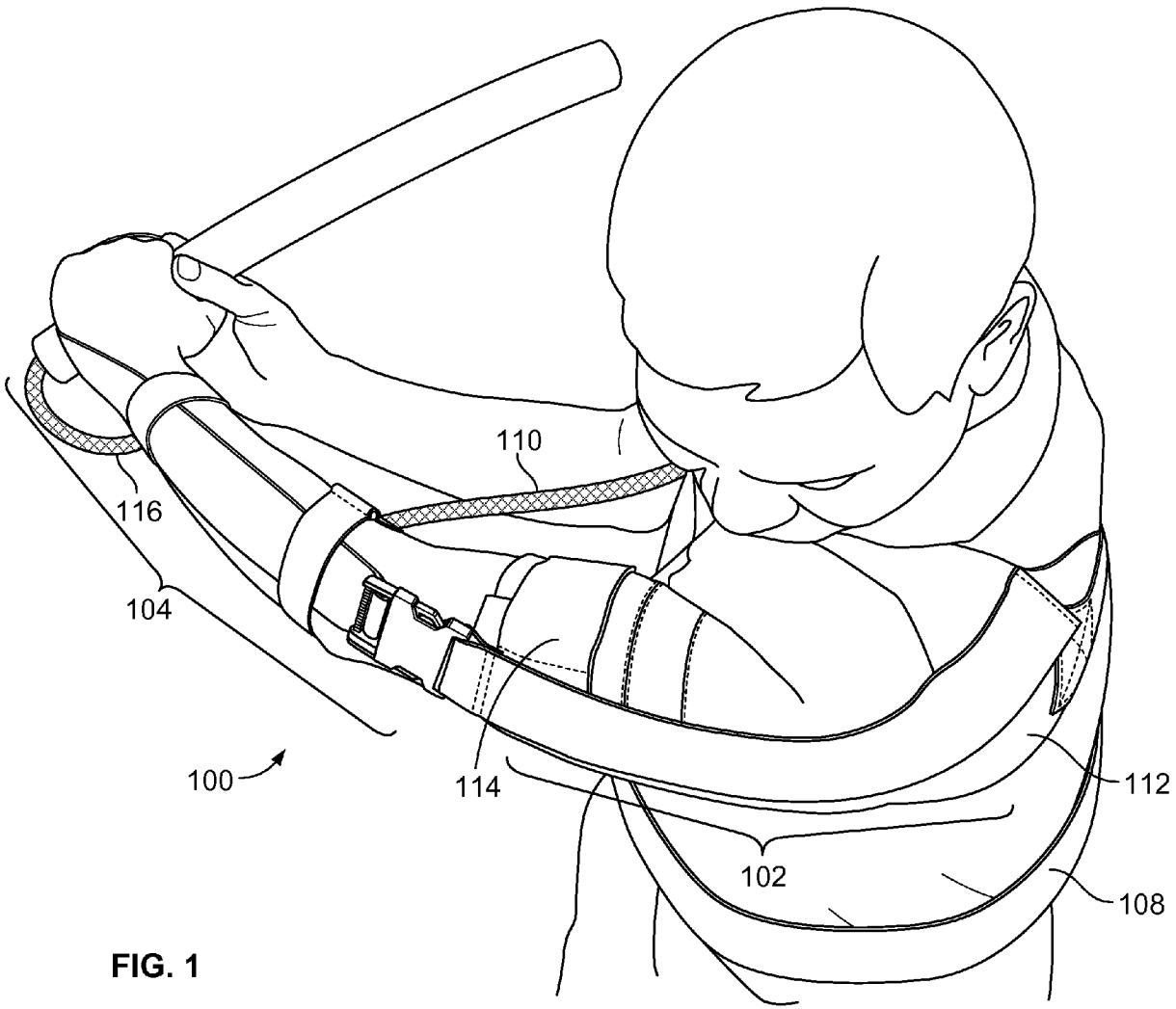
FIG. 1 shows an example gold training aid.

Referring now to FIG. 1, an example golf training aid 100 is shown. In general, the golf training aid 100 may be worn on a shoulder and be deployed down the leading swing arm of the wearer. For example, if the wearer executes a right-handed golf swing, the leading arm and shoulder (or forearm) is the wearer's left arm and shoulder. Alternatively, if the wearer executes a left-handed golf swing, the leading arm and shoulder (or forearm) is the wearer's right arm and shoulder. In some implementations, the golf training aid 100 may be configured to be worn on a specific shoulder of the wearer but allows for the positioning of other aspects of the golf training aid 100 based on the handedness of the wearer. For example, the golf training aid 100 may be worn on the left shoulder but a strap or other extension maybe be positioned down the lead arm of the wearer despite a portion of the golf training aid 100 being positioned on the left shoulder of the wearer. Different configurations of the golf training aid 100 are described in more detail below.

The golf training aid 100 includes a number of different components that can be attached to one another so as to restrict bending of one or more joints in the wearer's leading arm and/or shoulder. For example, the golf training aid 100

(and respective components) can be constructed using a flexible material that provides resistance when stretched. As a result, when the golf training aid 100 is properly worn (e.g., as illustrated in FIG. 1 for a right-handed golfer), the wearer of the golf training aid 100 receives resistance feedback when their golf swing is attempted to be executed using incorrect mechanics. This may be, for example, because the various components of the golf training aid 100 are positioned such that they provide substantially no resistance feedback when a golf swing is executed with proper mechanics and an increasing amount of resistance feedback as the mechanics of a particular golf swing worsen. Because the feedback is in the form of resistance, the user's motion is somewhat restricted, so as to encourage/promote proper swing mechanics. For example, the more the wearer attempts to bend their elbow, the more resistance the wearer will feel as they execute their golf swing, and hence the more feedback they will receive.

In a particular implementation, the golf training aid 100 includes a shoulder harness 102 and an arm extension 104. In some implementations, the shoulder harness 102 and the arm extension 104 may be removably attached allowing for easy storage while still enabling easy assembly. For example, the shoulder harness 102 and the arm extension 104 may be removably attached using one or more of nylon fabric fasteners (such as Velcro or other similar material), plastic clips, other suitable fasteners, or combinations of these. In other implementations, portions of the shoulder harness 102 and the arm extension 104 may be more permanently attached, reducing assembly time. For example, an area of the shoulder harness 102 may be sewn, glued (e.g., using a suitable fabric glue), or otherwise affixed using a more permanent manner of fixation to an area of the arm extension 104.

Figure 2A:
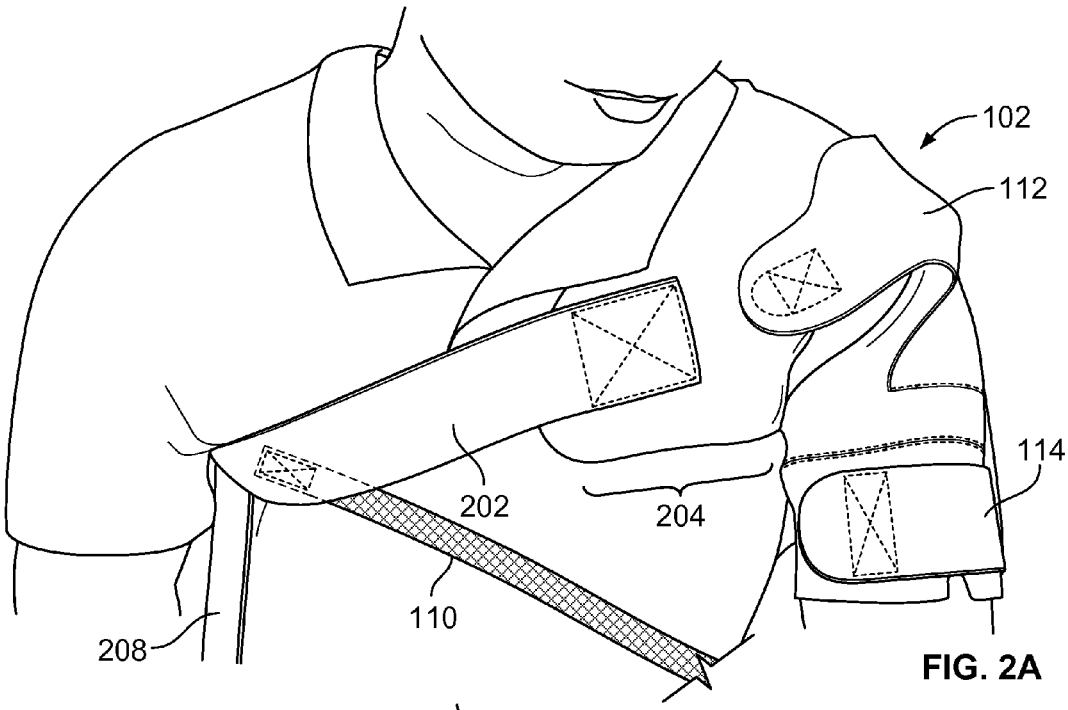
FIG. 2A shows a front view of a shoulder harness of an example golf training aid.
Figure 2B:
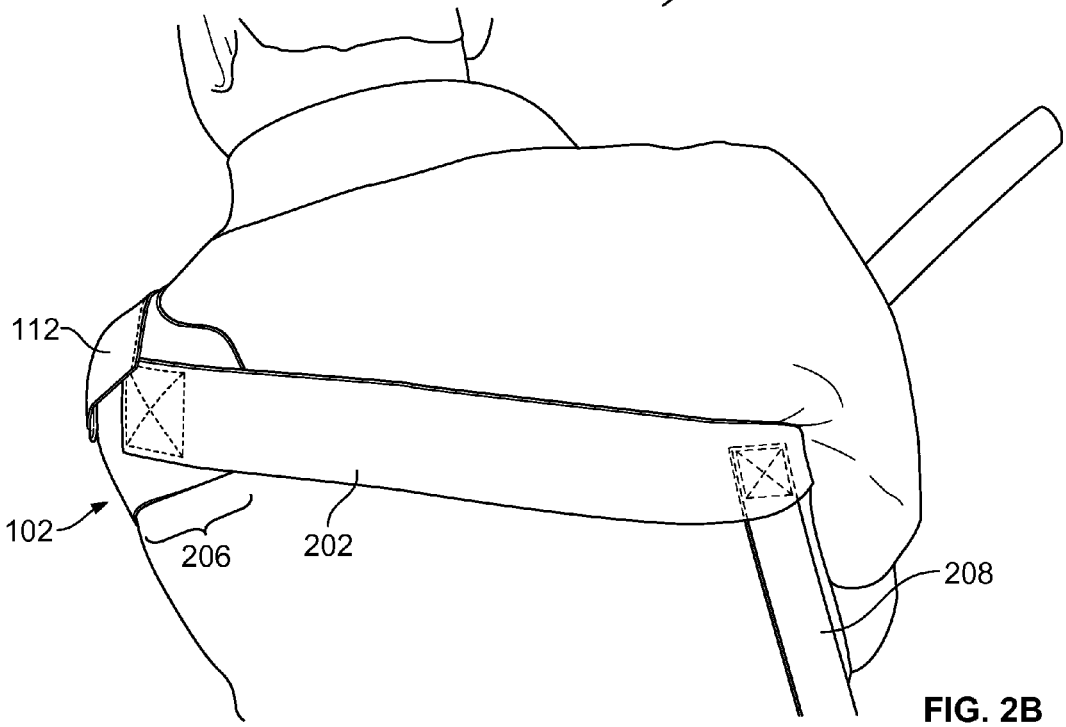
FIG. 2B shows a front view of a shoulder harness of an example golf training aid.

Each of the shoulder harness 102 and the arm extension 104 may include additional portions or components that achieve different and desired effects. Examples of additional portions are shown in FIG. 1 and/or are described in more detail with reference to FIGS. 2A-4, below. Referring again to FIG. 1, the shoulder harness 102 includes a first shoulder portion 112 and a second shoulder portion 114. The first shoulder portion 112 may include a strap (e.g., as shown in FIGS. 2A and 2B). The strap is described in more detail below.

The second shoulder portion 114 may also be attached to the arm extension 104. In some implementations, the arm extension 104 can be configured to be deployed down the wearer's leading arm. In some implementations, the arm extension can be constructed of flexible material that stretches when deployed and maintains tension along the upper and lower arm of the wearer so as to restrict bending of the elbow as the wearer executes the golf swing. For example, the arm extension 104 can be configured or otherwise arranged with respect to the elbow of the wearer so as to maintain proper arm extension of the wearer (e.g., maintaining a proper bend of the wearer's elbow). If the wearer's arm were to bend during execution of a golf swing, the wearer would experience some amount of resistance from the arm extension 104. In some implementations, the amount of resistance that the wearer experiences is based on the amount of bend in the wearer's elbow during execution of the golf swing and the amount of tension in the arm extension. Tensioning and the various components of the arm extension 104 are described in more detail below.

In some implementations, the golf training aid 100 may include optional components that can be used to provide a combination of additional resistive feedback when the wearer executes a golf swing and additional structural support. In some implementations, the golf training aid 100 includes a strap 108 that can be wrapped around the wearer's waist, a cord 110 that attaches to a portion of the golf training aid 100 near the wearer's non-leading shoulder and also attaches to a portion of the golf training aid 100 near the elbow of the wearer's leading arm. In the depicted example, the cord 110 can attach to an area near the wearer's right shoulder and also attach to a strap near the wearer's left elbow. In some implementations, the golf training aid 100 may also include a cord 116 that attaches to a base of a club (or other swinging device) and also attaches to a portion of the golf training aid 100 near the wrist of wearer's leading arm.

The strap 108 can be constructed using a flexible material that can be stretched to various sizes. The material may also provide resistance when stretched. In some implementations, the strap 108 provides an additional anchor point to other components of the golf training aid 100, such as components described in reference to FIGS. 2A and 2B, below providing additional stability for the golf training aid 100.

In some implementations, the cord 110 can be constructed of an elastic or stretchable material. In some implementations, the cord 110 maintains a relative distance between the elbow and shoulder regions to which the cord 110 is attached. In an example, the cord 110 may allow for some freedom of movement of the leading arm but will provide increasing levels of resistance or tension as the distance of the leading arm from the non-leading shoulder exceeds an original predefined length of the cord 110.

In some implementations, the cord 116 can also be constructed of an elastic or stretchable material. In some implementations, the cord 116 maintains a position of a hand or wrist relative to the leading arm of the wearer. In some implementations, the cord 116 may provide increasing levels of resistance or tension as the hand moves in a generally upward direction relative to the ground (and by extension the wrist moves in a generally upward direction) as the wearer executes a golf swing.

In some implementations, both cords 110 and 116 can be removably attached from one or more of the components in which they are attached. In some implementations, the cords 100 and 116 may be more permanently attached to reduce assembly time or to increase overall stability of the golf training aid 100. For example, the cords 100 and 116 may be sewn, glued (e.g., using a suitable fabric glue), or otherwise affixed using a more permanent manner of fixation to respective areas of the golf training aid 100.

FIGS. 2A-2B show a front view and a back view, respectively, of the shoulder harness 102 of an example golf training aid 100. Referring to FIG. 2A, portions of the first shoulder portion 112 and the second shoulder portion 114 are shown. In particular, the first shoulder portion 112 is shown with a region 204 that can be used to detachably affix a strap 202 after passing around a body of a wearer wearing the golf training aid 100. For example, the strap 202 may include one opposing side of Velcro (e.g., the "hook" side or the "loop" side), and region 204 may be constructed from the other opposing side of Velcro (e.g., the "loop" side if the strap 202 includes the "hook" side, and so forth), although other fasteners may also be used. In some implementations, the cord 110 can be attached (removably or otherwise) to a portion of strap 202 near the wearer's shoulder.

Referring now to FIG. 2B, a back portion of the first shoulder portion 112 is shown. In particular, the back portion of the first shoulder portion 112 includes a region 206 that can be used to fixedly attach the strap 202 to the back portion of the first shoulder portion 112. In some implementations, the strap 202 can be attached using a temporary fixation means. For example, the strap 202 may include one opposing side of Velcro (e.g., the "hook" side or the "loop" side), and region 206 may be constructed from the other opposing side of Velcro (e.g., the "loop" side if the strap 202 includes the "hook" side, and so forth), although other fasteners may also be used. In some implementations, the strap 202 may be more permanently attached to region 206. For example, the strap may be sewn, glued (e.g., using a suitable fabric glue), or otherwise affixed to region 206 using a more permanent manner of fixation.

Referring to both FIGS. 2A and 2B, in some implementations, the golf training aid 100 may also include an optional strap 208 that can be used to provide additional stability for the golf training aid 100 and also to provide additional resistance. In some implementations, the strap 208 can be removably attached to strap 202 and strap 108 (FIG. 1) to provide additional stability. The strap 208 can also be constructed of a flexible material that exerts a resistance when a wearer using improper mechanics executes a golf swing. In some implementations, as the wearer's posture changes during execution of the golf swing (e.g., when the wearer's torso moves farther over the wearer's leading leg), the wearer may feel a resistance or tension exerted by the strap 208.

Figure 3:
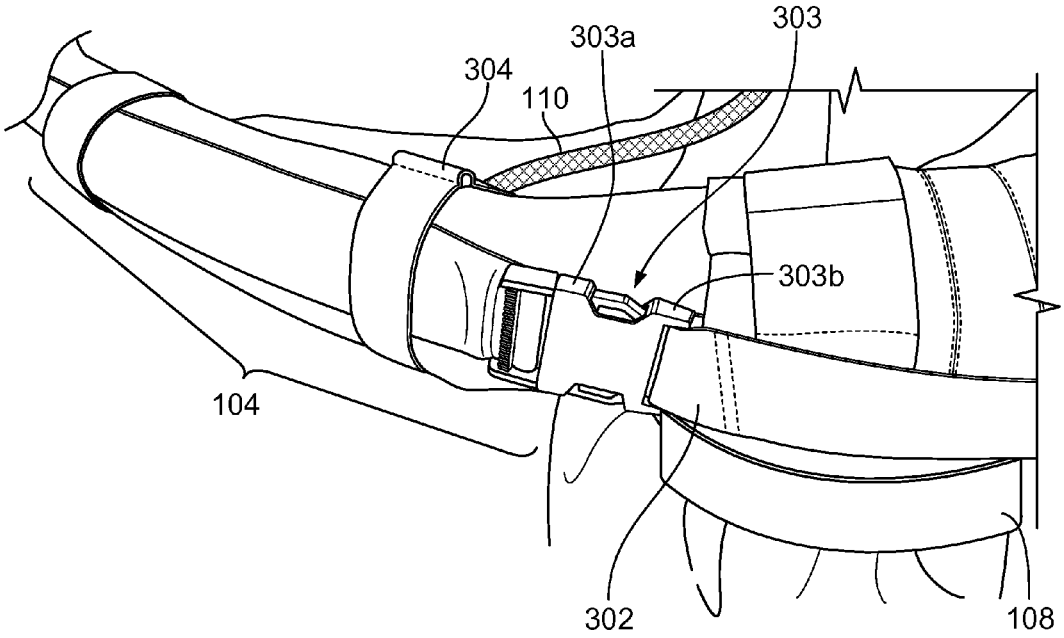
FIG. 3 shows a close-up view of an arm extension of an example golf training aid.
Figure 4:
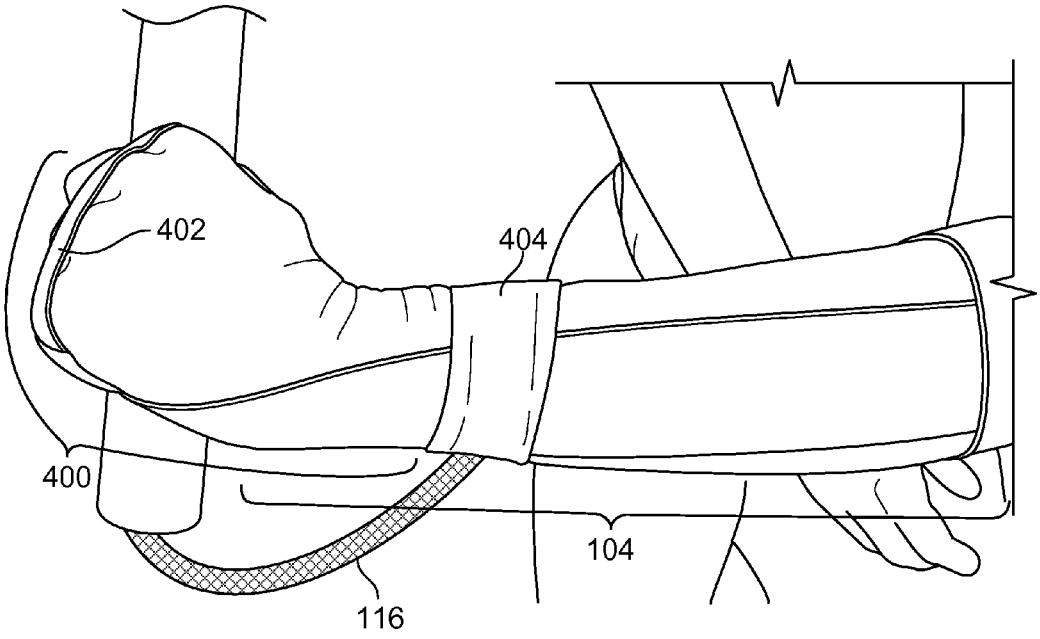
FIG. 4 shows a close-up view of a wrist portion of an example golf training aid.

FIG. 3 shows a close-up view of an arm extension 104 of an example golf training aid 100. In general, the arm extension 104 can be deployed so that a wearer experiences a resistance force at or near the elbow (e.g., above or below) when the wearer's golf swing is executed using improper mechanics. In the depicted example, the arm extension 104 includes an upper attachment portion 302 and a lower attachment portion 304. The arm extension 104 also includes a wrist portion 400 (FIG. 4). The wrist portion 400 is described in more detail in reference to FIG. 4. In general, the upper attachment portion 302 and the lower attachment portion 304 are configured for securing the arm extension 104 in place at upper and lower portions of a wearer's arm so as to maintain the arm extension 104 over the elbow of the wearer. In some implementations, the cord 110 can be attached (removably or otherwise) to the lower arm attachment portion 304.

For example, the upper attachment portion 302 may be a fastener or other attachment mechanism that fixedly attaches the arm extension 104 with the first shoulder portion 112. In a particular example, the upper attachment 302 may be a first end 303*a* of a plastic clip 303 (e.g., a male end or a female end) that is attached to the arm extension 104. The first end 303*a* can mate with a second end 303*b* of the plastic clip 303 that is affixed to the first shoulder portion 112 so as to secure both ends 303*a* and 303*b* of the clip.

In some embodiments, the arm extension 104 is constructed of a woven and knitted elastic material. For example, the arm extension 104 can be constructed out of nylon or other woven and knitted elastic materials. In such embodiments, the arm extension 104 can be used to create tension along the length and localized pressure at (at, above or below) the elbow portion 302 of the arm extension 104 after deployment so as to inhibit bending of the elbow of the wearer during golf swing execution.

In some implementations, the arm extension 104 is configured to be attached to either the first shoulder portion 112 or the second shoulder portion 114 so as to enable training for either left or right handed golfers. In the depicted example, the arm extension 104 is attached to the first shoulder portion 112 and extends down the left arm of the wearer. Such a configuration would enable training of right handed golfers (e.g., because the lead arm of a right handed swing is the left arm) using the resistance feedback described herein. Alternatively, when the arm extension 104 is attached to the second shoulder portion 114 and extends down the right arm of the wearer, such a configuration enables training of left handed golfers.

FIG. 4 shows a close-up view of a wrist portion 400 of an example golf training aid 100. In general, the wrist portion 400 of the arm extension 104 can be deployed so that tension along the arm extension 104 is maintained down the entirety of the wearer's arm. In some implementations, the wrist portion 400 may also be deployed so that a wearer experiences a resistance force at or near the wrist when the wearer's golf swing is executed using improper mechanics. In the depicted example, and as described above, the arm extension 104 includes the wrist portion 400. In some embodiments, at least some of the wrist portion 400 may be constructed using the same or similar materials that are used in the construction of the arm extension 104 more generally. For example, the wrist portion 400 can be constructed of a woven and knitted elastic material, such as nylon or other woven and knitted elastic materials.

In some implementations, the wrist portion 400 may be used both to secure the arm extension 104 and to provide resistance feedback on the wrist of the wearer. For example, the wrist portion 400 may include a grip portion for enabling the wearer to maintain a grip on a distal portion of the arm extension 104. In a particular example, the wrist portion 400 may include a grip portion 402 that includes a strap configured for wrapping around the wearer's hand so as to increase tension along the arm extension 104. As a result, when the wearer executes a golf swing, there is sufficient tension across the lead arm and wrist of the wearer (e.g., that causes resistance of the flexible material across the lead arm and wrist), such that a change in tension or resistance can be felt by the wearer when they execute a golf swing with improper mechanics.

A number of embodiments of the invention have been described. Nevertheless, it will be understood that various modifications may be made without departing from the spirit and scope of the invention. Accordingly, other embodiments are within the scope of the following claims.

What is claimed is:

1. A golf training aid comprising:

A shoulder harness adapted to be positioned over a leading shoulder of a wearer of the golf training aid, the shoulder harness including one or more surfaces that, when worn by the wearer of the golf training aid, are located on the leading shoulder of the wearer;

a first flexible strap for securing the shoulder harness to the wearer of the golf training aid;

an arm extension attached to the shoulder harness, the arm extension configured to be deployed down the wearer's leading arm, the arm extension including an extended portion and a wrist portion, the extended portion being configured to secure the arm extension in place at upper and lower portions of the wearer's leading arm so as to maintain the arm extension over the elbow of the wearer's leading arm, the wrist portion being configured to wrap around a leading hand of the wearer so as to enable the wearer to maintain a grip on a distal portion of the arm extension when deployed, wherein the arm extension is constructed of flexible material that stretches when deployed and maintains tension along the upper and lower portions of the wearer's leading arm so as to restrict bending of the elbow of the leading arm as the wearer executes a golf swing.

2. The golf training aid of claim 1 wherein the wrist portion is further configured to increase tension along the arm extension when the wrist portion is wrapped around the leading hand of the wearer.

3. The golf training aid of claim 1 wherein the arm extension is configured to be deployed down the wearer's left arm for a right-handed golfer or a right arm for a left-handed golfer.

4. The golf training aid of claim 1 wherein the arm extension is constructed of a woven or knitted elastic material.

5. The golf training aid of claim 1 wherein the arm extension is constructed of a stretchable material so as to create tension along the length and localized pressure at the elbow portion of the arm extension after deployment so as to inhibit bending of the elbow of the wearer during golf swing execution.

6. The golf training aid of claim 1 wherein the first flexible strap for securing the shoulder harness to the wearer of the golf training aid includes a first fastener at a first end of the first flexible strap and a second fastener at a second of the first flexible strap that are each adapted to removably attach to the shoulder harness.

7. The golf training aid of claim 6 wherein the first flexible strap is further adapted to pass around a body of the wearer of the golf training aid from a front portion of the leading shoulder of the wearer, under a trailing arm of the wearer opposite the leading shoulder, and to a back portion of the leading shoulder of the wearer.

8. The golf training aid of claim 1, further comprising a second flexible strap that is configured to attach between a first structure of the golf training aid located on a non-leading shoulder of the wearer and a second structure of the golf training aid located on the wearer's leading arm so as to maintain tension between the wearer's leading arm and non-leading shoulder and to resist separation of the leading arm from the non-leading shoulder during execution of the golf swing.

9. The golf training aid of claim 8 wherein one end of the second flexible strap is configured to attach to a location on the inner elbow of the leading arm of the wearer.

* * * * *

UNITED STATES PATENT AND TRADEMARK OFFICE

CERTIFICATE OF CORRECTION

PATENT NO. : 8,852,015 B1
APPLICATION NO. : 14/064060
DATED : October 7, 2014
INVENTOR(S) : Ben Hoang It is certified that error appears in the above-identified patent and that said Letters Patent is hereby corrected as shown below:

In the Claims

Column 6, line 45, in Claim 1: Delete "A" and insert --a--; and

Column 7, line 19, in Claim 6: Delete "second" and insert --second end--.

Signed and Sealed this
Third Day of February, 2015

Michelle K. Lee

Michelle K. Lee
*Deputy Director of the United States Patent and Trademark Office*